US005388766A

United States Patent [19]

Buisson

[11] Patent Number: 5,388,766

[45] Date of Patent: Feb. 14, 1995

[54] HIGH PRESSURE ATOMIZATION SYSTEMS FOR HIGH VISCOSITY PRODUCTS

[75] Inventor: Gerard L. Buisson, Cincinnati, Ohio

[73] Assignee: The Procter & Gamble Company, Cincinnati, Ohio

[21] Appl. No.: 125,461

[22] Filed: Sep. 22, 1993

[51] Int. Cl.[6] ..... B05B 11/02

[52] U.S. Cl. ..... 239/333; 239/492; 222/321

[58] Field of Search ..... 239/333, 492, 493, 469; 222/321

[56] References Cited

U.S. PATENT DOCUMENTS

| | | | |
|---|---|---|---|
| 3,061,202 | 10/1962 | Tyler | 239/333 |
| 3,761,022 | 9/1973 | Kondo | 239/333 |
| 3,865,313 | 2/1975 | Kondo | 239/333 |
| 3,921,861 | 11/1975 | Kondo | 222/257 |
| 4,051,983 | 10/1977 | Anderson | 222/321 |
| 4,077,548 | 3/1978 | Beard | 222/321 |
| 4,077,549 | 3/1978 | Beard | 222/321 |
| 4,082,222 | 4/1978 | Boris | 239/331 |
| 4,089,442 | 5/1978 | Hafele et al. | 222/321 |
| 4,124,148 | 11/1978 | Vieler et al. | 222/321 |
| 4,183,449 | 1/1980 | Blake | 222/321 |
| 4,186,855 | 2/1980 | Edman et al. | 222/321 |
| 4,189,064 | 2/1980 | O'Neill et al. | 222/321 |
| 4,198,756 | 4/1980 | Dragan | 222/326 |
| 4,228,931 | 10/1980 | Ruscitti et al. | 222/321 |
| 4,274,560 | 6/1981 | Cater | 222/321 |
| 4,821,928 | 4/1989 | Su | 239/333 |
| 4,936,492 | 6/1990 | Amiel et al. | 222/207 |
| 4,941,595 | 7/1990 | Montaner et al. | 239/333 |
| 4,944,432 | 7/1990 | Jouillat | 222/321 |
| 5,011,046 | 4/1991 | Graf et al. | 222/321 |
| 5,025,958 | 6/1991 | Montaner et al. | 222/321 |
| 5,064,105 | 11/1991 | Montaner | 222/321 |
| 5,088,649 | 2/1992 | Hanson et al. | 239/329 |
| 5,092,495 | 3/1992 | Andre | 222/341 |
| 5,115,980 | 5/1992 | Skorka | 222/321 |
| 5,176,296 | 1/1993 | Lina et al. | 222/321 |

FOREIGN PATENT DOCUMENTS

| | | | |
|---|---|---|---|
| 402636 | 12/1990 | European Pat. Off. | B65D 83/14 |
| 93/06749 | 4/1993 | WIPO | A23L 1/24 |

OTHER PUBLICATIONS

Calmar Inc. Fact Sheet, Mark IV, distributed Fall 1992.

Show in Print, The Mark IV, A New Generation Fine--Mist Sprayer—Article from pp. 80–81 of Sep. 1992 issue of Happi Magazine.

MS150 Precompression Spring Force Variations, Calmar letter dated Oct. 23, 1991.

*Primary Examiner*—Andres Kashnikow

*Assistant Examiner*—Christopher G. Trainor

*Attorney, Agent, or Firm*—William Scott Andes; Dean L. Garner

[57] ABSTRACT

The present invention pertains to improved manually operated atomization systems which combine atomizing nozzles with high pressure, pre-compression type pump mechanisms in order to provide a consistent, high quality, finely-atomized spray of a comparatively higher viscosity fluid. The pre-compression pump mechanism ensures that the product will only be delivered when sufficient pressure is available for atomization regardless of the speed or authority with which the pump mechanism is actuated. When the fluid is discharged from the nozzle in a swirling, conical film, the fluid is broken up into a finely-dispersed mist which may then be directed toward the surface to be coated. Pump mechanisms for use with the present invention incorporate specific design features which facilitate the flow of comparatively viscous fluids with reduced flow resistance and hence reduced pressure losses, as well as providing enhanced structural integrity to better withstand such operating pressures and forces while providing improved reliability. The combination of pre-compression and comparatively higher operating pressures ensures that the comparatively higher viscosity fluid will be delivered to the nozzle with a pressure (and hence a velocity) that is comparatively high and within a comparatively narrow range. This in turn ensures a finely-dispersed product spray with a comparatively narrow range of particle sizes, under a wide range of actuation circumstances.

18 Claims, 4 Drawing Sheets

HIGH PRESSURE ATOMIZATION SYSTEMS FOR HIGH VISCOSITY PRODUCTS

FIELD OF THE INVENTION

The present invention pertains to improved atomization systems for comparatively higher viscosity liquid products. More particularly, the present invention provides improved manually operated atomization systems which combine atomizing nozzles with high pressure, pre-compression type pump mechanisms in order to provide a consistent, high quality, finely-atomized spray of a comparatively higher viscosity fluid.

BACKGROUND OF THE INVENTION

The quantity of liquid product dispensed and the quality of the spray pattern are critical parameters which have a substantial impact on the performance of a liquid product applied via an atomized spray. This is particularly true when the liquid product is being utilized as a thin film coating on a surface (such as, for example, a cooking utensil or pan, a window, or even hair or skin), and the total quantity of liquid product applied and quality of the spray pattern directly impact the thickness and evenness of the product coating.

In view of the ever-increasing awareness and concern among consumers with respect to the use of chlorofluorocarbon (CFC) propellants (now largely discontinued due to their impact upon the ozone layer) and volatile organic compound (VOC) propellants (which aggravate low altitude pollution problems, and many are highly flammable), there has been a trend away from pre-pressurized hydrocarbon aerosol-type dispensing systems toward systems which utilize a manually-operated pump-type mechanism to force fluid through a specially-designed nozzle assembly to atomize the liquid product.

Many product formulations require the addition of thinning agents (such as water, alcohol, solvents, or other VOCs) in order to reduce the viscosity of the product to the point where it can be atomized with conventional, manually operated spray systems. However, such thinning agents are less than desirable from a consumer perspective because of their impact upon the performance of the product (such as the taste of food products), and (with some thinners such as alcohol or VOCs) the accompanying scent of the thinner and/or accompanying flammability problems. Other thinners such as water-based thinners may introduce microbial growth problems in the product.

While eliminating the use of thinners in product formulations addresses the problems encountered with such use, it is not without other problems. Comparatively higher viscosity (non-thinned) liquid products present an additional challenge in terms of atomization, as the liquid has a tendency to resist break-up rather than being dispensed as a finely dispersed mist. As a general proposition, the less finely dispersed the spray produced, the more difficult is it to achieve a comparatively thin and uniform layer of product on the intended surface, and hence product effectiveness in use is correspondingly diminished.

There are many products which may be applied to a surface via a manually operated spray system, including cleaning products, food products, surface coatings, and health and beauty care products. One particular product application of current interest is in the area of oil-based fluid products used in food preparation, such as pan coatings and flavor enhancers. A thin, even coating of the oil-based product is desirable in order to provide for non-stick baking characteristics in the pan coating context and to prevent over-application of flavor enhancers. Such products usually comprise a vegetable oil and may optionally include a small quantity of additives for stability, performance, and flavor enhancement. Other products of interest include hair sprays, which also require a thin even coating for satisfactory performance.

One currently commercially available pump sprayer for cooking oil products employs a nozzle design which produce two impinging jets of the product which collide outside the nozzle to atomize the liquid product. These impingement-type spray systems, particularly with comparatively higher viscosity product formulations, tend to produce a spray having a comparatively wide distribution of particle sizes. This is disadvantageous in terms of overall spray quality, as larger particles tend to travel farther than the smaller particles and tend to cause regions of heavier product concentration, while smaller particles tend to form a "cloud " of product which bounces off of the intended surface to be coated, only to float about in the air. By utilizing a finite number of impinging fluid streams, commercially available impingement-type systems also tend to produce a number of zones of heavier product application equal to or greater than the number of impinging streams. These tendencies generally become exaggerated with increasingly higher viscosities and smaller pump dosages.

The performance of these commercially available spray systems also suffers due to use of conventional pump technology which allows the product to emerge in a poorly atomized spray at the beginning and end of each pump stroke when the available pressure is less than required for atomization. Comparatively higher viscosity fluids typically have a narrower window of operating pressures which will provide satisfactory atomization than comparatively lower viscosity fluids, with such operating windows becoming increasingly narrow with increasing viscosity. Under some circumstances, such as when the pump is slowly actuated, a comparatively higher viscosity product fails to be atomized at all, and emerges from the nozzle assembly in a fluid stream. In this particular application, the result is wasted product and oversaturation of the food item or baking surface to be coated. Heavy drippage of product from the sprayer may also occur, which is generally messy and unsanitary in a food preparation environment.

While other commercially available dispensing systems employing single-orifice, swirl-type atomizing nozzles may work satisfactorily with comparatively lower viscosity formulations, their performance with comparatively higher viscosity formulations suffers due to several factors. First, viscous losses with comparatively higher viscosity fluids do not allow the fluid to attain enough swirl velocity to form a conical film, and thus do not facilitate break-up of the fluid into a finely dispersed spray. Second, the viscous nature of the fluid itself resists break-up of the fluid. The role of viscosity is to inhibit the growth of instabilities and generally delay the onset of disintegration. This causes atomization to occur farther downstream from the nozzle orifice in regions of lower relative velocity; consequently, drop sizes are comparatively larger. When the viscosity becomes too high, atomization is inhibited and streaming of the fluid occurs. Finally, while the first problem may be addressed if not overcome by the use of higher dispensing pressures, commercially available pump systems of this variety cannot sustain the pressures required to satisfactorily atomize comparatively higher viscosity fluids.

Thus, even though commercially available swirl-type atomization systems may in general (with comparable pressures and product viscosities) produce a narrower distribution of spray particle sizes and a more continuous (uniform) product distribution (without discrete zones of heavier application) than the commercially available impingement-type spray systems, their performance with comparatively higher viscosity formulations suffers because of their tendency to completely fail to atomize the product when the dispensing pressure is inadequate, resulting in a stream of liquid product being ejected from the nozzle.

Accordingly, it would be desirable to provide a manually operated pump-type product delivery system which would provide for a well-atomized, finely-dispersed spray of product with more uniform particle sizes and a more uniform spray pattern under all actuation circumstances when comparatively higher viscosity formulations are utilized.

SUMMARY OF THE INVENTION

The present invention provides an improved product delivery which combines an atomizing nozzle with a high pressure, pre-compression type pump mechanism in order to provide a consistent, high quality, finely-atomized, evenly-distributed spray of a comparatively higher viscosity fluid.

The pre-compression pump mechanism ensures that the product will only be delivered when sufficient pressure is available for atomization. Regardless of the speed or authority with which the pump mechanism is actuated, pressure within the pump will accumulate without product discharge until a threshold pressure is reached, at which time a valve opens to permit product discharge with sufficient pressure for atomization. Correspondingly, when available pressure begins to fall at the end of a pump stroke (or the trigger or actuator button is released during an incomplete cycle), the valve closes when the pump pressure falls below this threshold, thus eliminating product streaming or dribble at the end of the delivery stroke. When the fluid is discharged from the nozzle in a swirling, conical film, the fluid is broken up into a finely-dispersed mist, directed toward the surface to be coated.

The beneficial performance aspects of the product delivery systems of the present invention are consistently obtained due to the comparatively high operating pressure threshold designed into the pump mechanism itself. With swirl type atomizer nozzles, comparatively higher viscosity fluids can be successfully atomized if driven through the nozzle with sufficient velocity. These velocities can be achieved only if sufficient internal operating pressures are available to drive the fluid through the nozzle.

Pump mechanisms for use with the present invention incorporate specific design features which facilitate the flow of comparatively viscous fluids with reduced flow resistance and hence reduced pressure losses. Design features are also included to provide enhanced structural integrity to better withstand such operating pressures and provide improved reliability. The combination of pre-compression and comparatively higher operating pressures ensures that the comparatively higher viscosity fluid will be delivered to the nozzle with a pressure (and hence a velocity) that is comparatively high and within a comparatively narrow range. This in turn ensures a finely-dispersed product spray with a comparatively narrow distribution of particle sizes, under a wide range of actuation circumstances.

The resulting product delivery system provides a consistent, high quality spray for a comparatively higher viscosity product formulation, rendering it easy to use and eliminating the need for additives to thin the product as required in many other product delivery systems.

BRIEF DESCRIPTION OF THE DRAWINGS

The present invention will be better understood with reference to the following Detailed Description and to the accompanying Drawing Figures, in which.

With respect to all Drawing Figures, unless otherwise noted like elements are identified with like numerals for simplicity and clarity.

DETAILED DESCRIPTION OF THE PREFERRED EMBODIMENTS

Figure 1:
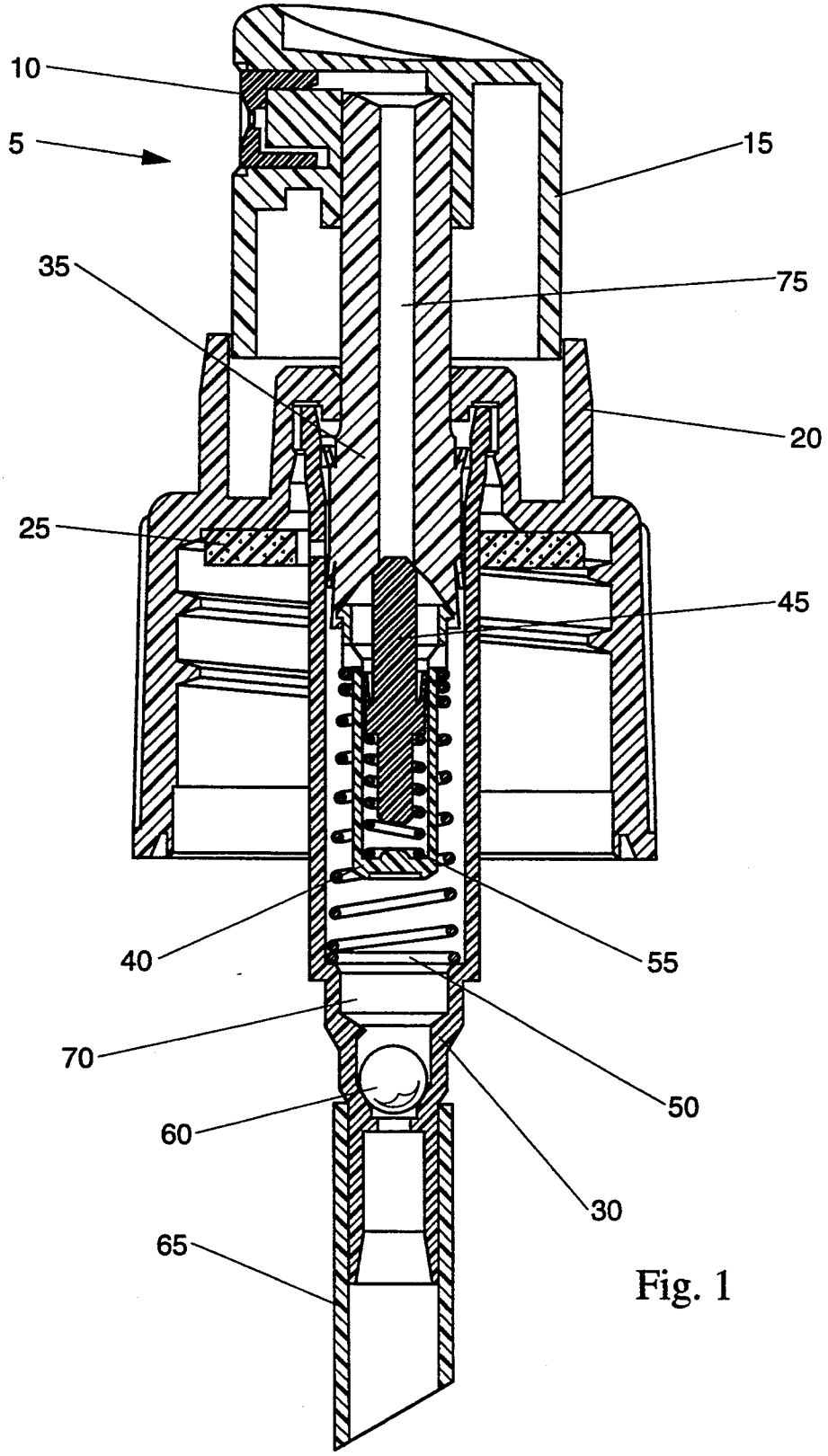
FIG. 1 is an elevational sectional view of a product delivery system according to the present invention.

FIG. 1 illustrates an improved pump sprayer 5 for use with a product delivery system according to the present invention. The system includes a nozzle insert 10 incorporated into an actuator button 15, a closure 20 (with a gasket 25) which is suitable for attaching the pump sprayer 5 to a suitable container of conventional design (not shown), an outer cylinder 30, a primary piston 35, an inner cylinder 40, a discharge valve 45, a return spring 50, a pre-compression spring 55, a check (ball) valve 60, and a supply tube 65 extending downward within the container from the pump mechanism.

While a wide variety of pre-compression type pump mechanisms may be suitable for use in the present invention, the particular reciprocating finger-pump version illustrated in FIG. 1 is illustrative of the operating features typical of such pump mechanisms and is a presently preferred configuration for retail applications. A more detailed description of the features and components of this type of pump assembly may be found in U.S. Pat. No. 4,941,595, issued Jul. 17, 1990 to Montaner et al., U.S. Pat. No. 5,025,958, issued Jun. 25, 1991 to Montaner et al., and U.S. Pat. No. 5,064,105, issued Nov. 12, 1991 to Montaner, each of which are hereby incorporated herein by reference. Pump assemblies of these general types are commercially available versions sold by Calmar Dispensing Systems, Inc. under the trade name "Calmar Mark IV".

As the operating principles of pre-compression type pump mechanisms themselves are generally well-known, a brief overview of their operation with respect to the product delivery systems according to the present invention is as follows: To begin a pumping cycle, the actuator button 15 is actuated (pushed downward) by finger pressure, increasing the fluid pressure within the pressure chamber 70 by reducing the volume of the pressure chamber as the primary piston 35 is pushed downward within the outer cylinder 30. Check valve 60 prevents fluid from being driven back down the supply tube 65 into the container (not shown) as the pressure increases within the pressure chamber 70. The pressurized fluid acts upon a discharge valve 45, causing it to open to a delivery passageway 75 once the force on the discharge valve 45 exceeds the biasing force of a pre-compression spring 55. The pressurized fluid travels through the delivery passageway 75 to the nozzle assembly 10, where it is discharged as a finely atomized product spray. Once the primary piston 35 reaches the end of its travel (or the actuator button is released during an incomplete cycle), and pressure within the pump assembly diminishes to the point where the discharge valve 45 no longer is held open, the discharge valve 45 closes under the action of the pre-compression spring 55 and fluid flow out of the nozzle 10 ceases. If the actuator button 15 is then released, a return spring 50 returns the actuator button 15 to its initial position (thereby drawing fluid up through the supply tube 65 past the check ball valve 60 and into the pressure chamber 70), where it is ready for the next pumping cycle.

Figure 2:
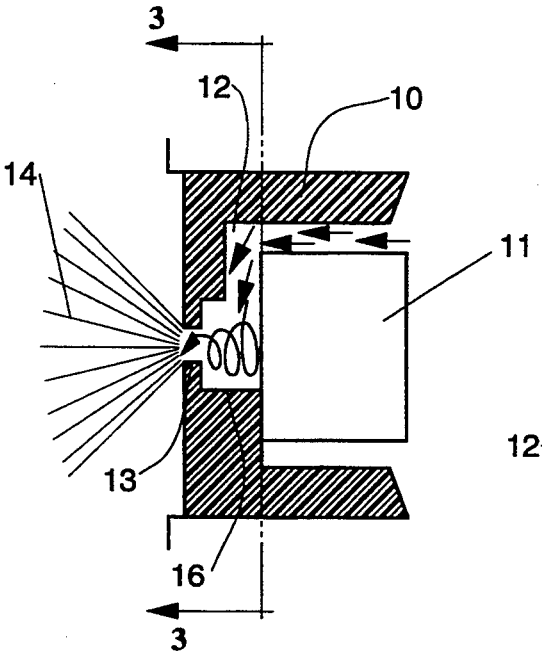
FIG. 2 is an enlarged elevational sectional view of the nozzle assembly depicted in FIG. 1.
Figure 3:
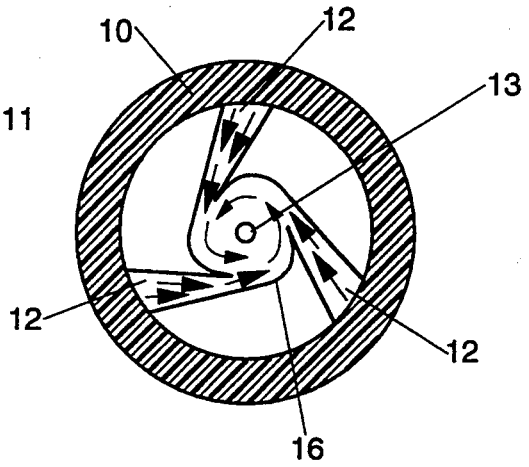
FIG. 3 is a cross-sectional view of the nozzle assembly of FIG. 2 taken along line 3—3.

FIGS. 2 and 3 depict with greater clarity the structure and operation of a typical swirl-type atomizer nozzle assembly of the type depicted in FIG. 1. The fluid product is directed within the nozzle insert 10 around a center post 11 and into one or more (in this instance, three) tangential passageways 12, which supply fluid to a swirl chamber 16. Because the fluid is introduced tangentially into the swirl chamber, a rotating or swirling motion is imparted to the fluid as indicated by the small arrows. The swirling fluid is then discharged from the outlet orifice 13 as an expanding hollow cone. As the cone expands, its film thickness decreases until the fluid starts breaking up into ligaments, which will in turn break up further into small droplets (as indicated at 14). This break-up is further aided by the surrounding environment (air turbulence). The general design and operation of swirl-type atomizer nozzles of this general variety are conventional, and the configuration depicted is merely illustrative for the purposes of the discussion which follows.

One of the features essential to achieving the improved atomization properties of delivery systems according to the present invention is the inclusion of a pre-compression type pump mechanism which generates a comparatively high operating pressure.

In order to ,achieve satisfactory atomization with swirl-type nozzle designs, comparatively higher viscosity fluids require higher operating pressures to drive the fluid at velocities high enough to shear the fluid and achieve atomization. Such fluids also have a more narrow operating window of pressures which will perform satisfactorily, particularly in terms of a comparatively higher low-pressure threshold below which the resulting spray pattern will be unsatisfactory. When the available operating pressure is less than this threshold, the resulting fluid dispensed will tend to emerge in a stream rather than a mist or spray. Heavy drippage of product from the sprayer may also occur, which is generally messy and undesirable from a consumer perspective.

The difficulty encountered with conventional direct-action type pump mechanisms is that pressure tends to build gradually during the early stages of a pump stroke, reaching a maximum somewhere during the travel of the pump toward its end-of-travel limit, then rapidly falling once this limit is reached. The peak pressure is often less (and the pressure rise more gradual) if the pump mechanism is actuated rather slowly, and if the actuation occurs slower than the fluid passes through the nozzle orifices, pressure may never build up significantly within the dispensing system.

With swirl-type nozzle designs, if the fluid stream has insufficient velocity, the fluid will not be atomized at all but will stream from the outlet orifice, resulting in wasted product and overapplication to the desired surface, as well as the messiness and other undesirable consequences which thus result. In addition, once a streaming condition is reached the product will generally fail to transition to a swirling conical film and will continue to emerge in a stream even if the dispensing pressure reaches the critical pressure.

The use of a pre-compression pump mechanism in product delivery systems according to the present invention ensures that the product will only be delivered when a sufficient comparatively high pressure is available for atomization. This is accomplished through the use of a discharge valve which typically utilizes a pre-compression spring under a particular pre-load to effectively block fluid flow out of the pump chamber during the period of initial pressure rise and during the rapid decrease of pressure at the end of the pumping cycle.

Regardless of the speed or authority with which the pump mechanism is actuated, pressure within the pump will accumulate without product discharge until a threshold pressure is reached, at which time a valve opens to permit product discharge with sufficient pressure for atomization. Correspondingly, when available pressure begins to fall at the end of a pump stroke, the valve closes when the pressure falls below this threshold, thus eliminating product streaming or dribble at the end of the delivery stroke. Product is thus discharged only when the operating pressure is within an operating range or "window" which will provide satisfactory atomization based upon the product formulation and nozzle geometry employed. The threshold pressure thus constitutes the lower end of this operating range or "window" of satisfactory operating pressures. When the fluid exits the nozzle orifice as an expanding, hollow conical film, the fluid has sufficient velocity to be broken up into a finely dispersed mist which may then be directed toward the surface to be coated.

The beneficial performance aspects of the product delivery systems of the present invention are consistently obtained due to the comparatively high operating pressure threshold designed into the pump mechanism itself. With swirl type atomizer nozzles, comparatively higher viscosity fluids can be successfully atomized if driven through the nozzle with sufficient velocity. These velocities can be achieved if sufficient internal operating pressures are available to drive the fluid through the nozzle. However, commercially available pumps are not designed for or capable of generating and sustaining such comparatively high pre-compression forces and pressures.

Pump mechanisms for use with the present invention incorporate specific design features which facilitate the flow of comparatively viscous fluids with reduced flow resistance and hence reduced pressure losses. Design features are also included to provide enhanced structural integrity to better withstand such operating pressures and provide improved reliability. The combination of pre-compression and comparatively higher operating pressures ensures that the comparatively higher viscosity fluid will be delivered to the nozzle with a pressure (and hence a velocity) that is comparatively high and within a comparatively narrow range. This in turn ensures a finely-dispersed product spray with a comparatively narrow range of particle sizes, under a wide range of actuation circumstances.

Figure 4:
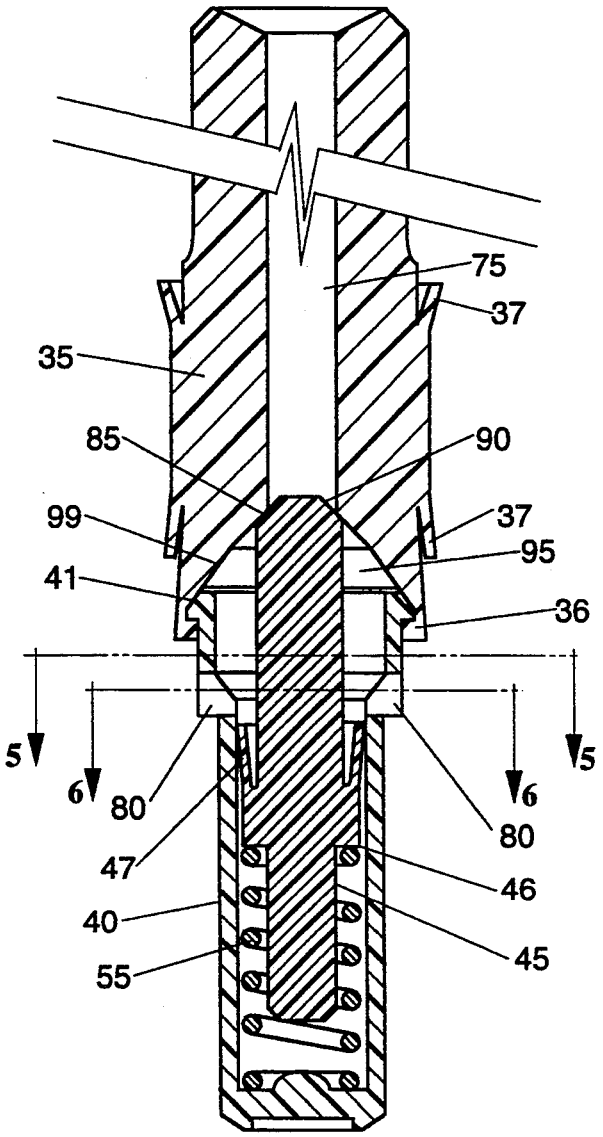
FIG. 4 is an enlarged elevational sectional view of the elements of the pump mechanism depicted in FIG. 1

Referring now to FIG. 4, it can more clearly be seen that the discharge valve 45 in a preferred embodiment is preferably of solid construction rather than hollow, in order to better withstand the force of the pre-compression spring over time, and the hydraulic pressures which it will be subjected to during the course of pumping operations. The discharge valve 45 also preferably incorporates a solid shoulder 46 of sufficient size to firmly contact the pre-compression spring 55 and withstand the force exerted by the spring. The pre-compression spring 55 itself has a pre-load tension which is selected according to the level of pre-compression, and hence the level of the threshold pressure, desired in a particular application and for a given pump mechanism configuration.

During operation, the pressure builds within the accumulation chamber 95 and acts upon the discharge valve via the valve flange 47. When the product of the pressure exerted on this area times the area itself exceeds the pre-load force exerted by the pre-compression spring, the end portion 90 of the discharge valve 45 will move away from the valve seat 85 on the primary piston 35 and permit fluid to be driven upward through the delivery passageway 75 within the primary piston 35 to the nozzle assembly 10. Not only may the pre-load tension of the pre-compression spring (in its initial position with the discharge valve closed) be tailored as desired, but the spring rate of the spring may also be varied to provide the desired force level in a particular size pump mechanism.

The currently commercially available pump assemblies exemplified by the "Calmar Mark IV" and described in U.S. Pat. No. 5,025,958, issued Jun. 25, 1991 to Montaner et al. and incorporated herein by reference, include many flow restrictions within the fluid passages of the pump mechanism which will result in what may be described as thin-film fluid flows during pump operation. Examples of such restricted fluid passages (see FIG. 1 ) are the comparatively narrow annular space between the "widened portion or pan 58" and the inner surface of the "shell member 20", the comparatively narrow apertures interrupted by the "longitudinal strips" of the "widened portion 48", which require the fluid to make two 90° turns to flow around the upper end of the "widened portion or pan 58", and the comparatively narrow annular space between the "upper extension 66" of the "secondary plunger 64" and the inner surface of the "main plunger 12".

Such flow restrictions within the prior art type of pump mechanisms exemplified by the pump sprayers of Montaner et at. '958 are a cause of the inferior atomization performance of these pump sprayers with fluids of comparatively higher viscosities. Indeed, with comparatively higher viscosity fluids the design of fluid passageways is particularly critical in terms of pressure losses and reduced fluid velocity and mass flow.

The lack of the requisite flow velocity, pressure, and flow rate at the nozzle is a critical factor in the poor atomization performance of the prior art pump sprayers with fluids of comparatively higher viscosities. By reducing the causes of pressure loss and flow reduction within the pump mechanism, the pump assemblies of the present invention provide the needed flow velocity, pressure, and flow rate at the nozzle entrance. Accordingly, the pump assemblies of the present invention incorporate passageways designed to facilitate fluid flow by eliminating thin-film fluid flow conditions within the pump mechanism itself.

FIG. 4 depicts a presently preferred embodiment of a pump assembly incorporating the modifications to the pump assembly which faciliate the flow of the comparatively high viscosity fluid. Pressure losses within the pump assembly are functions of a number of factors, including viscosity, density, passage size, surface roughness, and velocity, among others. Accordingly, the pump elements have been modified to facilitate the flow of comparatively higher viscosity fluids with the least possible resistance and in the greatest possible volumes.

In order to provide for improved fluid access to the interior of the accumulation chamber 95 from the annular region between the inner and outer cylinders, the inner cylinder 40 includes at least one (and preferably more) radial passageways 80 which provide direct fluid access into the interior of the acculumation chamber 95 without the fluid having to traverse a tortious path or encounter thin-film flow conditions. The number and size of these passageways 80 may be tailored to suit a particular product application, but must not be so large and/or numerous as to impair the structural integrity of the inner cylinder 40. The accumulation chamber 95 is also comparatively large in diameter in comparison with the diameter of the upper portion of the discharge valve 45, so as to facilitate the flow of the comparatively higher viscosity fluid through this annular space on its way toward the delivery passageway 75 when the discharge valve 45 moves away from the valve seat 85, and hence minimize pressure losses by the elimination of thin-film fluid flow.

Fluid flow through the accumulation chamber 95 is also facilitated by the tapering of the wall 99 of the chamber from the lower end near the coupling of the primary piston 35 and inner cylinder 40 toward the upper end at the valve seat 85. This gradual transition without sharp corners or abrupt profile changes aids in maintaining a smooth fluid flow and reduces pressure losses. This tapering also gradually increases the velocity of the fluid as it moves from a larger passage area near the passageways 80 toward the smaller area in the region of the valve seat 85 and the delivery passageway 75.

Insofar as the structural integrity of the pump mechanism is concerned, the coupling regions 36 and 41, respectively, of the primary piston 35 and the inner cylinder 40 are preferably solid throughout their circumferential extent for maximum strength and of sufficient thickness to withstand the forces encountered. These mating coupling regions preferably have a somewhat "barbed" profile which permits relative ease of assembly while rendering it extremely difficult for them to become disengaged in service when exposed to the high forces and stresses involved. Since fluid access to the accumulation chamber 95 is provided via passageways 80, there is no need to form these coupling regions in the shape of interlocking fingers or otherwise leave openings which tend to weaken this critical area.

In comparison with currently commercially available pump mechanisms of this general type, the coupling arrangement is also reversed in that the coupling portion 41 of the inner cylinder 40 is inside the coupling portion 36 of the primary piston 35. As the primary piston 35 is typically made of a softer, more compliant material than the inner cylinder 40 to better provide sealing against the wall of the outer cylinder 30 via sealing flanges 37, this orientation places the softer material in tension between the inner cylinder 40 and the outer cylinder 30, thereby reducing the tendancy of the softer material to deform and move away from a secure coupling engagement with the more rigid material of the inner cylinder 40.

Figure 5:
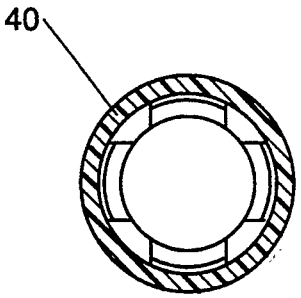
FIGS. 5 and 6 are enlarged cross sectional views of the inner cylinder depicted in FIG. 2 taken along lines 5—5 and 6—6, respectively.
Figure 6:
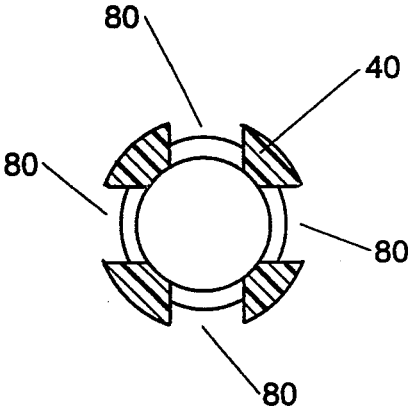

FIG. 5 more clearly illustrates the solid nature of the inner cylinder 40 construction in the vicinity of the coupling portion 41, while FIG. 6 more clearly illustrates the orientation of the fluid access passageways 80 which extend through the wall of the inner cylinder 40. These passageways are preferably radially oriented and equally spaced, in order to minimize to the extent possible the introduction of turbulence into the fluid as it enters the accumulation chamber 95. The passageways 80 may be of any desired shape consistent with the manufacturing method utilized, such as circular, elliptical, square, rectangular, etc. The number and size of the passageways may be varied to account for the properties of the fluid and the structural properties of the inner cylinder material, but it is presently believed that in terms of flow resistance and pressure losses that a smaller number of comparatively larger passageways is superior to a larger number of comparatively smaller passageways.

While these modifications have been described with respect to one particular presently preferred type of pump mechanism, it is to be understood that modifications could be undertaken with respect to other types of pump mechanisms of the pre-compression variety in order to produce a pump mechanism which has the structural integrity to generate and maintain the forces required with the present invention while minimizing internal pressure losses.

Any suitable materials may be utilized in the construction of the elements of the pump mechanisms of the present invention, taking into account the characteristics of the product itself (corrosive, sticky, etc.) and its intended application (food products, toxic chemicals, etc.). For the area of particular interest (food products), materials which have been found to be suitable include polypropylene (inner and outer cylinders), stainless steel (check valve, pre-compression spring, and return spring), low density polyethylene (supply tube), high density polyethylene (actuator button, primary piston, and discharge valve), and Celcon (nozzle insert). The elements of the pump mechanisms may be fabricated in any suitable fashion with regard to the materials selected, including injection molding, casting, machining, etc.

Figure 7:
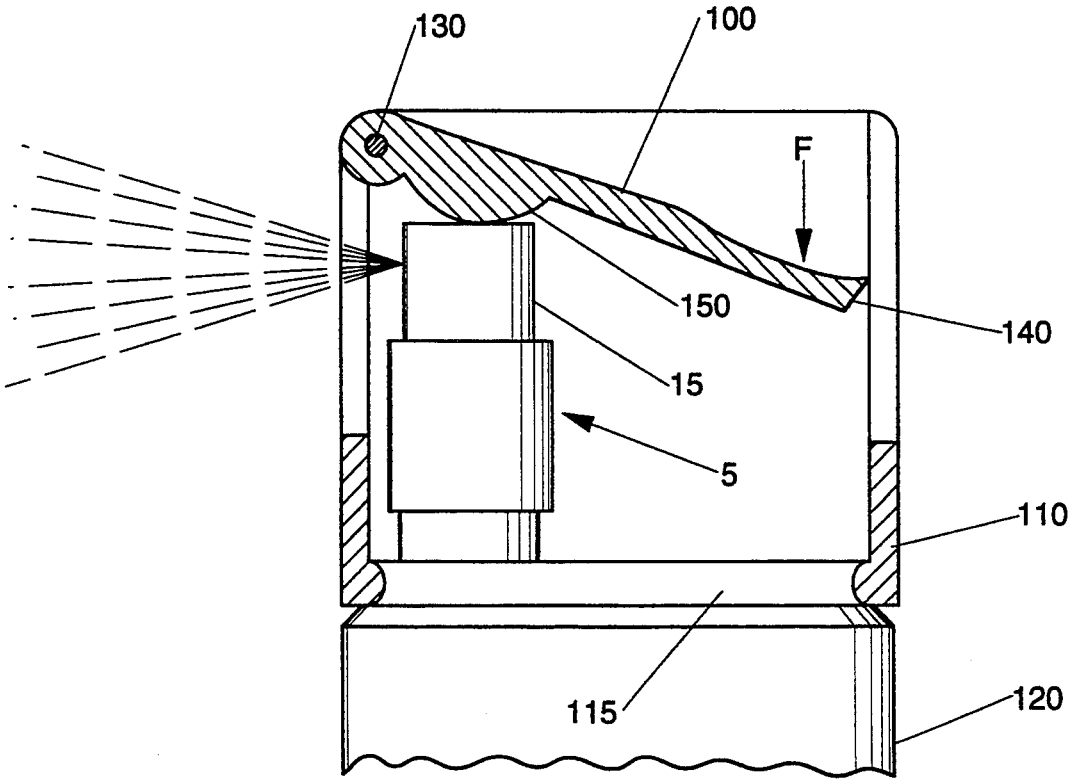
FIG. 7 is an elevational (partially sectional) view of an actuating lever suitable for use with a product delivery system according to the present invention.

An additional feature which may be desirable to include with the product delivery systems of the present invention is the use of an actuator lever, such as depicted in FIG. 7. An actuator lever 100, when utilized as shown, provides a mechanical advantage for the consumer during the actuation process, reducing the consumer effort required to overcome the spring pressures and the pressure building within the pump mechanism during the dispensing operation. While not an essential element of the present invention, such an effort-reducing device improves consumer acceptance of this type of system without adding undue complexity.

The lever 100, in the configuration shown in FIG. 7, is part of an outer cap assembly 110 which may be affixed to the upper portion 115 of a container 120 in a surrounding relationship to the pump sprayer 5. The lever 100 is preferably hingedly connected to the outer cap assembly 110 by a hinge 130, and has a free end 140 conveniently located for easy access by a consumer. When a force F is exerted on the free end 140, an actuating force is in turn exerted on the actuator button 15 by the contacting portion 150 of the lever. Since, as depicted in FIG. 7, the distance from the free end 140 to the hinge 130 is greater than the distance from the contacting portion 150 to the hinge 130, the force exerted on the actuator button 15 is multiplied by the ratio of the free end distance over the contacting portion distance, thus providing the required actuation force while reducing the force F the consumer must provide to dispense the product. The ratio of these distances may be adjusted to provide the desired force multiplication and achieve a particular actuation force, and thus ergonomically tailored to match the desired consumer profile.

While one particular lever configuration has been herein described, it is to be understood that the present invention is independent of the use of an actuating lever and of any particular type of actuating lever, and a wide variety of lever-type actuating systems are believed to be suitable for use depending upon the overall package design to be utilized. Even within the realm of reciprocating spray pump mechanisms of the type herein described, other lever configurations which may be employed which are more in the form of a trigger or handle may be employed, and thus provide the desired mechanical advantage for the consumer.

While the improved product delivery systems according to the present invention may be utilized with virtually any fluid product, it has been found to be particularly advantageous in the cooking environment, where it may be utilized to apply pan coatings and flavor enhancers. These products are often formulated with a large percentage (80–100%) of a vegetable oil, and have viscosities typically of between about 60 and about 75 cps. Such products may also include a minor percentage of lecithin, emulsifiers, and may also include flavor enhancers and other ingredients to enhance product performance. Product formulations which have performed well with the product delivery systems of the present invention typically include approximately 88% vegetable oil, approximately 10% lecithin, and approximately 2% of an emulsifier, and have viscosities of approximately 70 cps. Such formulations do not include any thinning agents such as water or alcohol.

Other product formulations besides cooking products, particulary those of comparatively higher viscosities could be employed in product delivery systems according to the present invention. Such products include, but are not limited to: lubricating oils, liquid soaps, laundry detergents, dishwashing detergents, pretreaters, hard surface cleaners, paints, polishes, window cleaners, rust preventatives, surface coatings of all varieties, health and beauty care products such as hair sprays, etc. Other cooking and food related products besides pan coatings and flavor enhancers include, but are not limited to, liquid salad dressings, marinades, and flavored oils.

The advantages of product delivery systems according to the present invention are particularly apparent when the viscosity of the product formulations is comparatively higher than, for example, such comparatively lower viscosity products which are substantially water-based and have viscosities between about 1 and about 10 cps. The term "comparatively higher viscosity", as used herein, is therefore intended to refer to fluids having a viscosity of at least about 30 cps. Fluids having viscosities higher than about 30 cps, such as in the 60–75 cps range, have been found to perform successfully with product delivery systems according to the present invention.

Operating pressures (more particularly, the lower pressure thresholds) of the pre-compression type pump mechanisms for use with the present invention are preferably on the order of about 50 to about 300 psig (about 345 to about 2068 kPa), more preferably at least about 100 psig (about 690 kPa), and perhaps higher, although this pressure may be tailored to suit any particular application depending upon the product formulation (viscosity in particular) and nozzle geometry employed. For products such as the cooking oil products described above, the operating pressure is preferably at least about 200 psig (1379 kPa).

An additional benefit derived from the use of comparatively higher operating pressures is that such product delivery systems are generally better able to accomodate liquid products containing some quantity of solid particulate matter (such as, for example, salt particles) in suspension form. These solid particulates tend to increase the likelihood of clogging of the passageways and orifices in nozzle assemblies, and the use of comparatively higher operating pressures tends to aid in forcing free any particulates which cling to the sides of passageways and orifices, thus reducing the likelihood of clogging and poor spray quality. These anti-clogging attributes are also advantageous with certain fluids, such as hair spray or oils, which may suffer from an increase in viscosity as they age and/or deteriorate and likewise tend to cause clogging.

While a presently preferred version of the improved product delivery systems according to the present invention employs a reciprocating finger-pump type of actuation system, as depicted in FIG. 1, the features of the present invention could be likewise incorporated into a wide variety of alternative pump systems and those employing differing actuation mechanisms, such as trigger-type actuation systems of the rotary or linear type, for example. The reciprocating finger-pump type of actuation system has been found to lend itself particulary well to product application situations where a relatively small quantity of product per stroke is required at a comparatively higher operating pressure.

A wide variety of nozzle geometries may be employed in product delivery systems according to the present invention depending upon the desired spray pattern and the characteristics of the product formulation to be utilized. Although the improved product delivery systems herein described are of particular interest with respect to pressure swirl atomizer nozzle of the general type illustrated, other nozzle technologies could be employed, including (but not limited to) impingement-type nozzle technology. The benefits derived via the present invention with any type of nozzle utilized would include improved atomization, consistency, and reduced drippage and streaming of product. Another advantage obtained with the use of a nozzle system which performs the atomization without the introduction of air, propellant, or any other gas into the fluid stream, is that the tendancy toward producing a airborne "cloud" of very fine product particles which bounce off of the intended application surface is further reduced.

Although the primary focus herein has been on the use of such systems in the context of applying a liquid product to a surface of any variety, it is also to be understood that the advantages with respect to atomization quality may also be realized in the context of airborne misting or fogging applications as well.

While particular embodiments of the present invention have been illustrated and described, it would be obvious to those skilled in the art that various changes and modifications can be made without departing from the spirit and scope of the present invention. For example, the product formulation and viscosity can be tailored to suit a particular application, the actuator design and pre-compression pump mechanism can be selected to achieve particular operating characteristics, the container size and design may likewise be varied, the nozzle design may be varied, the operational and structural characteristics of the system may be ergonomically tailored for the desired consumer profile, etc. It is intended to cover in the appended claims all such modifications that are within the scope of this invention.

What is claimed is:

1. A high pressure dispensing and atomization system, said system comprising:

(a) a comparatively high viscosity fluid product;

(b) a container for storing said product prior to dispensing and atomizing said product;

(c) a manually operated pump sprayer for dispensing said product from said container, said pump sprayer being associated with an opening in said container so as to permit dispensing of said product from within said container when said pump sprayer is actuated during a dispensing operation, said pump sprayer further including a pre-compression pump mechanism, wherein said product is dispensed only when a pre-determined pressure value is exceeded within said pump sprayer, said predetermined pressure value comprising a comparatively high threshold pressure defining a lower end of an operating range;

(d) a nozzle assembly associated with said pump sprayer for dispensing and atomizing said product; and (e) said pump mechanism further including fluid passages sized to eliminate thin-film fluid flow within said pump mechanism during said dispensing operation and provide improved operating efficiency and reduced pressure losses such that when said when said threshold pressure is exceeded said product is discharged from said pump sprayer through said nozzle assembly with sufficient velocity to atomize said product.

2. The dispensing and atomization system of claim 1, wherein said product has a viscosity of at least about 30 cps.

3. The dispensing and atomization system of claim 1, wherein said product includes a vegetable oil.

4. The dispensing and atomization system of claim 1, wherein said product includes solid particulate material, and whereby said comparatively high threshold pressure reduces the likelihood of clogging of said nozzle assembly.

5. The dispensing and atomization system of claim 1, wherein said pump sprayer comprises a finger pump type sprayer.

6. The dispensing and atomization system of claim 1, wherein said pump sprayer further includes a means for providing a mechanical advantage during actuation of said pre-compression pump mechanism.

7. The dispensing and atomization system of claim 6, wherein said means for providing a mechanical advantage comprises an actuating lever.

8. The dispensing and atomization system of claim 1, wherein said nozzle assembly includes a pressure swirl atomizer nozzle.

9. The dispensing and atomization system of claim 1, wherein said threshold pressure is at least about 50 psig.

10. A high pressure dispensing and atomization system, said system comprising:

(a) a comparatively high viscosity fluid product;

(b) a container for storing said product prior to dispensing and atomizing said product;

(c) a manually operated pump sprayer for dispensing said product from said container, said pump sprayer being associated with an opening in said container so as to permit dispensing of said product from within said container when said pump sprayer is actuated during a dispensing operation, said pump sprayer further including a pre-compression pump mechanism, wherein said product is dispensed only when a pre-determined pressure value is exceeded within said pump sprayer, said predetermined pressure value comprising a comparatively high threshold pressure defining a lower end of an operating range;

(d) a nozzle assembly associated with said pump sprayer for dispensing and atomizing said product; and (e) said pump mechanism further including a first cylinder and a second cylinder within said first cylinder, said second cylinder having an outer wall and an interior located radially inwardly of said outer wall, said second cylinder including a discharge valve within said interior and a pre-compression spring for biasing said discharge valve toward a closed position, said pump mechanism having at least one radial passage extending through said outer wall to provide direct non-tortious fluid communication of said product from an area between said first cylinder and said second cylinder into the interior of said second cylinder such that said product is permitted to flow through said outer wall of said second cylinder to act upon said discharge valve, said radial passages being sized to eliminate thin-film fluid flow within said precompression pump mechanism to achieve improved operating efficiency and reduced pressure losses such that when said product acts upon said discharge valve with sufficient pressure to exceed said threshold pressure said product is discharged from said pump sprayer through said nozzle assembly with sufficient velocity to atomize said product.

11. The dispensing and atomization system of claim 10, wherein said product has a viscosity of at least about 30 cps.

12. The dispensing and atomization system of claim 10, wherein said product includes a vegetable oil.

13. The dispensing and atomization system of claim 10, wherein said product includes solid particulate material, and whereby said comparatively high threshold pressure reduces the likelihood of clogging of said nozzle assembly.

14. The dispensing and atomization system of claim 10, wherein said pump sprayer comprises a finger pump type sprayer.

15. The dispensing and atomization system of claim 10, wherein said pump sprayer further includes a means for providing a mechanical advantage during actuation of said pre-compression pump mechanism.

16. The dispensing and atomization system of claim 10, wherein said nozzle assembly includes a pressure swirl atomizer nozzle.

17. The dispensing and atomization system of claim 10, wherein said threshold pressure is at least about 50 psig.

18. The dispensing and atomization system of claim 10, wherein said discharge valve contacts a valve seat, said discharge valve further being surrounded by a passageway within said second cylinder, and wherein said passageway is tapered from said radial passage toward said valve seat such that said product is permitted to flow smoothly and freely past said discharge valve toward said nozzle assembly during product discharge.

* * * * *

UNITED STATES PATENT AND TRADEMARK OFFICE

CERTIFICATE OF CORRECTION

PATENT NO. : 5,388,766

DATED : February 14, 1995

INVENTOR(S) : Gerard L. Buisson

It is certified that error appears in the above-identified patent and that said Letters Patent is hereby corrected as shown below:

In Col. 14, line 6, Claim 10, "passages" should read --passage--.

In Col. 14, line 8, Claim 10, "precompression" should read --pre-compression--.

Signed and Sealed this

Twenty-sixth Day of November 1996

Bruce Lehman

*Attest:*

BRUCE LEHMAN

*Attesting Officer*

*Commissioner of Patents and Trademarks*